United States Patent [19]

Sheppard

[11] Patent Number: 4,715,452

[45] Date of Patent: Dec. 29, 1987

[54] METHOD OF DRILLING A DIRECTONAL WELL BORE

[75] Inventor: Michael Sheppard, Cambridge, England

[73] Assignee: Prad Research and Development NV, Curacao, Netherlands Antilles

[21] Appl. No.: 816,668

[22] Filed: Jan. 7, 1986

[30] Foreign Application Priority Data

Jan. 8, 1985 [GB] United Kingdom ..... 8500458

[51] Int. Cl.[4] ..... F21B 7/04

[52] U.S. Cl. ..... 175/61

[58] Field of Search ..... 175/61, 62, 73, 75

[56] References Cited

U.S. PATENT DOCUMENTS

| | | | |
|---|---|---|---|
| 3,042,125 | 7/1962 | Duncan | 175/61 |
| 4,386,665 | 6/1983 | Dellinger | 175/61 |
| 4,433,738 | 2/1984 | Moreland | 175/61 |
| 4,440,241 | 4/1984 | Anders | 175/61 |
| 4,480,701 | 11/1984 | Baldwin | 175/61 X |
| 4,523,652 | 6/1985 | Schuh | 175/61 |
| 4,621,691 | 11/1986 | Schuh | 175/62 X |

*Primary Examiner*—Stephen J. Novosad
*Assistant Examiner*—David J. Bagnell

[57] ABSTRACT

The invention relates to a method of drilling a directional well bore with a drill string. According to the invention, at least a part of the trajectory of the well bore is drilled with a constant build rate so that the part has substantially a constant curvature shape.

3 Claims, 6 Drawing Figures

METHOD OF DRILLING A DIRECTONAL WELL BORE

The invention relates to a method of drilling a directional well bore, usually in order to produce a fluid, such as oil and/or gas, contained in an underground formation.

Many oil or gas wells are not drilled vertically but with a certain angle or inclination to vertical. The target location, determined before drilling, does not lie vertically below the surface location of the drilling rig. This is particularly true when drilling offshore when a cluster of wells is drilled from the same rig. The majority of these deviated wells are of the "build and tangent" type, depicted in FIG. 1. From the rig R located at the surface S, the well is first drilled downwards vertically to a prescribed depth $D_1$. Then, the well trajectory kicks off and the angle of inclination to vertical is built, ideally at some fixed rate, to some predetermined angle $\theta$ formed between a vertical line and the longitudinal axis of the well bore. This part of the borehole is called the build section. Then, the hole is drilled straight at the target T in the oil or gas producing formation F, maintaining the inclination angle as close to $\theta$ as possible until the target is reached. This last part of the hole is called the tangent section.

The drilling assembly, or drill string, used to drill a well is mainly composed of a pipe string with a drilling bit at its lower end and drill collars located just above the bit. Drill collars are heavy tubes (compared with drill pipes), used to put weight on the drill bit. Usually, all the available weight is not applied to the bit, i.e. the drill string is retained at the surface. Consequently, the upper part of the drill string is under tension and the lower part is under compression. The point in-between, where the stress changes from tension to compression is the neutral point which is usually located in the upper part of the drill collars section.

However, for deviated wells, the hook load when drawing the drill string out of the hole (tripping out) is substantially greater than the free (rotating) weight of the string. In addition, the torque required at the surface to achieve a given (lower) torque at the bit is substantially greater in the case of a deviated well than in the case of a vertical well of similar length.

In general, drag and torque loss in a drill string system are associated with the side forces acting along the drill string giving rise to a frictional interaction between the string and the well bore. The side forces are comprised of two components depicted in FIG. 2 and associated with:

the local curvature c of the string (which is taken to lie in a vertical plane) giving rise to a term T.c where T is the local tension and the component of the buoyed mass of the string acting orthogonally to the tangent to the trajectory. This gives rise to a term of the form mg sin ($\dot{\theta}$) where $\theta$ is the inclination angle and m the buoyed mass of the drill string per unit length.

The total contribution of these two terms to the drag or the torque loss is given by a term depending on the coefficient of friction of the form:

$$\mu|mg \sin(\theta) - Tc|$$

integrated over the entire length of the string.

In certain circumstances, particularly in long reach wells, the induced drag can be of such a magnitude that the drilling process is hindered. This can occur either because it becomes difficult or impossible to trip out or because the torque required to rotate the drill string exceeds the rating of the rotary table.

U.S. Pat. No. 4,440,241 describes a method of drilling a well bore that substantially reduces the likelihood of the drill string becoming stuck and reduces the frictional forces between the drill string and the well bore. According to this method, the well bore is drilled along the path of a catenary curve. However, this method is very difficult to implement, because for a catenary curve, the variation of the inclination angle is not constant but has to increase continuously. In practice, drilling a borehole along a catenary path is an impossible task. For instance, if two stabilizers are used to deviate the trajectory of the borehole, the distance between the two stabilizers has to be increased regularly in a predetermined way. This is not easily achieved and it requires fine control from the directional driller. In addition, frequent correction runs to return the trajectory to catenary could readily give rise to regions of local dog legs which, in turn, would increase drag and torque. Another drawback of the method is that the inclination of the borehole when reaching the target location is often very large: the borehole lies nearly horizontally. This large inclination might not be appropriate with an efficient production of the formation fluid. It also increases the drag of the bottom hole assembly and therefore the side forces acting on the bore hole string, making worse the problems of borehole stability and stabilizer sticking.

The primary object of the invention is to provide a method of drilling a well bore that substantially reduces the drag and torque loss in the drill string system and that can be implemented easily.

According to the present invention, at least a portion of the borehole ending at the target location is drilled with a constant build rate (the build rate is the change of inclination per unit of pipe string length), so that said portion of the borehole has substantially a constant curvature shape.

In order that features and advantages of the present invention may be appreciated, an example will now be described with reference to the accompanying diagrammatic drawings of which:

The aim of the proposed method is to reduce the drag and torque loss experienced in most of the directional wells.

There are mainly two means of ameliorating the drag problems of a well. The first is to counter some of the load force in the tangent section while the second is to reduce the extent of the build section. The second of these is important since the build section is high in the drill string, tension is consequently large and the side force and associated drag is high in this region. Reduction of the side forces not only reduces drag but also reduces the wear on the casing (the steel tube which lines the well bore).

Figure 1:
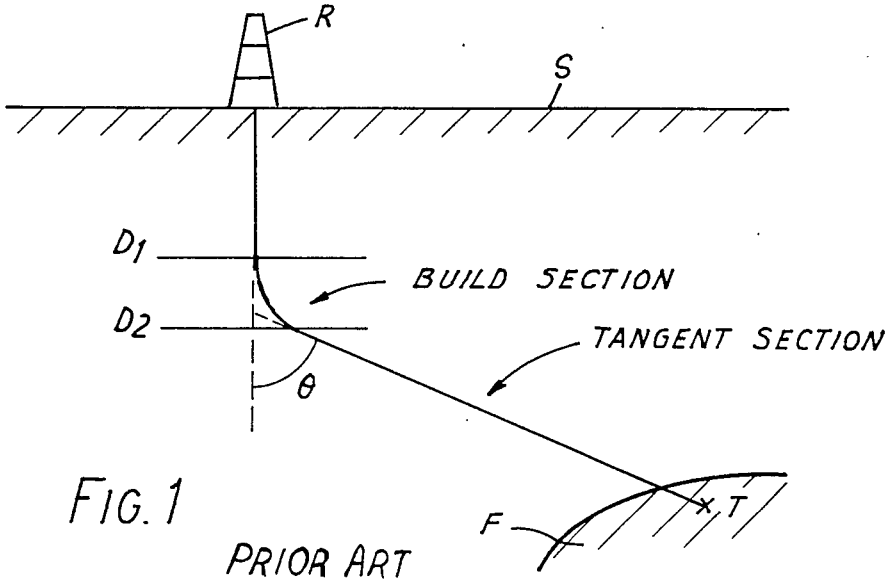
FIG. 1 PRIOR ART
FIG. 1 represents the trajectory of a well drilled in accordance with the prior art.
Figure 2:
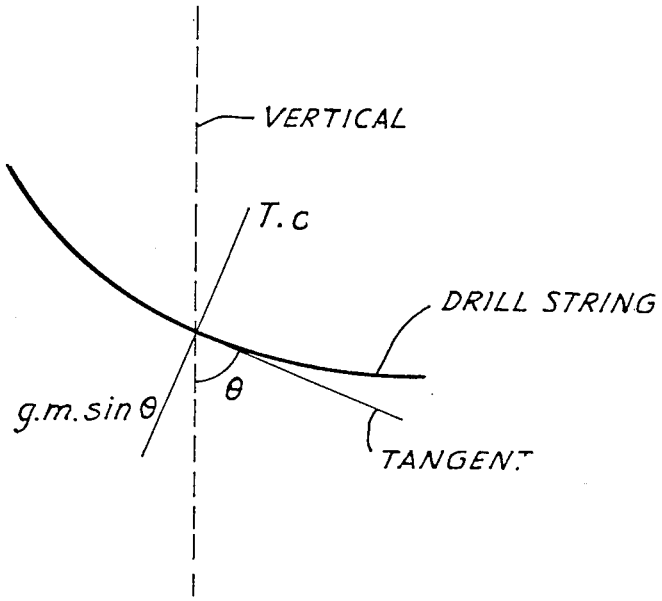
FIG. 2 represents the forces acting on a section of a drill string.

The method of the present invention combines both of the options outlined above. First, the conventional tangent section (also called "hold section") depicted in FIG. 1 is replaced by a constant (upward) curvature section to target. Second, the initial build section is reduced in extent so that the angle achieved at the end of the initial build section is lower than that required for a conventional build/tangent well. This reduction of the initial build section is the consequence of the use of a constant curvature section for the last part of the borehole.

In practice, the building characteristics of a well trajectory are achieved by the strategic placement of stabilizers in the bottom hole assembly of the drill string. In general, a given bottom hole assembly, at constant weight on bit, will tend to build angle at a fairly constant rate. In order to change slightly the inclination of the borehole, the driller modifies the weight on bit. For a substantial change of inclination, the driller has to modify the distance between the stabilizers. The drill string is therefore tripped out, the stabilizers positions in the borehole assembly is modified and the drill string lowered again in the borehole to resume the drilling operation.

Figure 3:
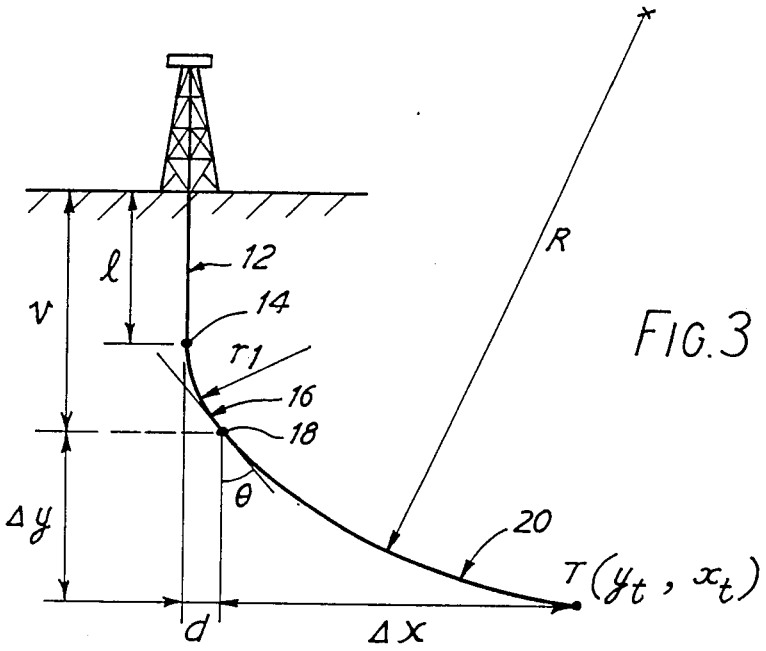
FIG. 3 shows the trajectory of a borehole drilled according to the invention.

The method for drilling a constant build trajectory well is illustrated on FIG. 3.

The initial vertical section 12 is drilled from the rig R to the desired detph 1 at which point 14 the well kicks off. The initial build section 16 is then drilled at a build rate b (degrees per hundred feet) generating an arc of radius $r_1$ where $$r_1 18000/\pi b$$

The initial build section is continued until point 18, where some pre-determined inclination angle $\theta$ is achieved. In general, the initial build section 16 will be a necessary requirement as it serves two purposes: to clear neighbouring wells as quickly as possible, in the case of high density of wells, such as for cluster wells, and to define an initial compass bearing for the well. The driller needs, as a matter of fact, to determine fairly quickly the azimuth of the borehole. This last requirement will normally constrain $\theta$ to take some value greater than about 15°–20°. Notwithstanding these comments, a well with no initial build section can be planned by taking $\theta=0$ in the following formulae.

At the end 18 of the initial build section, the vertical depth v is given by:

$$v=1+\text{rly}\sin\theta$$

and a horizontal displacement d given by $$d=r_1(1-\text{Cos}\,\theta)$$

For a well with a target (at some vertical depth $y_t$ and some horizontal displacement $x_t$ the quantities $\Delta x$ and $\Delta y$ are defined by:

$$\Delta x=x_t-d$$

and $$\Delta y=y_t-v$$

The constant build trajectory 20 from the end 18 of the initial build section 16 to the target T (with matching tangent at the end of the initial build section) is given by:

$$(x-d-\tilde{x})^2=(y-v-\tilde{y})^2=R^2$$

where x and y are the horizontal and vertical components relative to the rig location, and where:

$$\tilde{x}=\left(\frac{\Delta y}{2}+\frac{\Delta x}{2\Delta y}\right)^2\frac{\text{Cot}\,\theta}{1+\frac{\Delta x}{\Delta y}\text{Cot}\,\theta}$$

$$\tilde{y}=\frac{\Delta y}{2}+\frac{\Delta x)^2}{2\Delta y}-\frac{\Delta x\tilde{x}}{\Delta y}$$

The radius of curvature R is given by: $R=(\tilde{x}^2+\tilde{y}^2)^{\frac{1}{2}}$ To achieve this trajectory in practice, an appropriate bottom hole assembly is run at the end of the initial build section and the well is caused to build angle constantly at a rate of $18000/_R$ degrees per hundred feet until the target is reached. For a typical well, this value of the build rate would be between 0.2° and 0°5 per 100 feet.

Figure 4:
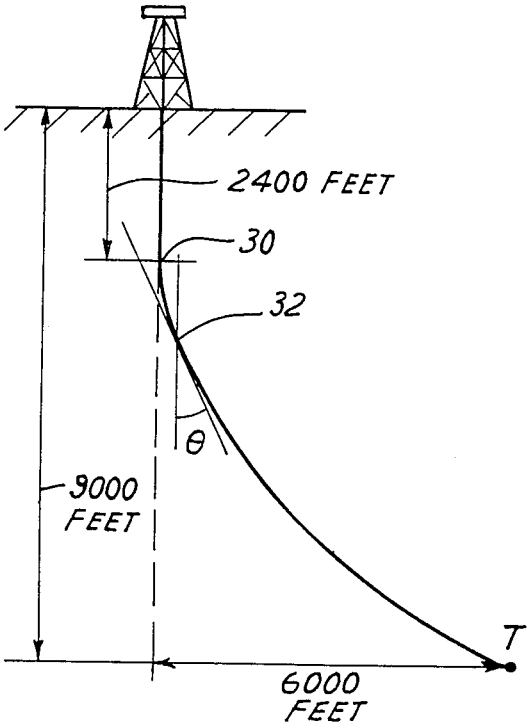
FIG. 4 shows a practical example of a well bore drilled according to the method of the invention.

Calculations of the total hook load, when tripping out from full depth, and of the rotary torque were made for a typical model, well shown in FIG. 4, to exhibit the possible reduction in drag and torque loss gained by using curved trajectories. The well is drilled vertically to a kick off point 30 at 2400 feet. The inclination was then build at a rate of 5° per 100 feet to some angle $\theta$ at point 32. This angle would be typically between 2° and 8° per 100 feet. The target T was at a total vertical depth of 9000 ft with a step out from the rig of 6000 feet. Drilled as a conventional build and hold trajectory (such as the well trajectory shown on FIG. 1) this would correspond to an inclination angle of 44.5°.

The model drill string was configured with 372 feet of 6½ inch drill collar and 840 feet of 5 inch heavyweight pipe with 5 inch drill pipe to surface. A mud weight of 9.8 lb per gallon was used. The drag and torque loss are a function of the coefficient of friction and this would normally be expected to lie in the range 0.2–0.4. In this example, a value of 0.4 was used to simulate harsh drag conditions. The torque loss calculation was made assuming a weight on bit of 38000 lb.

Figure 5:
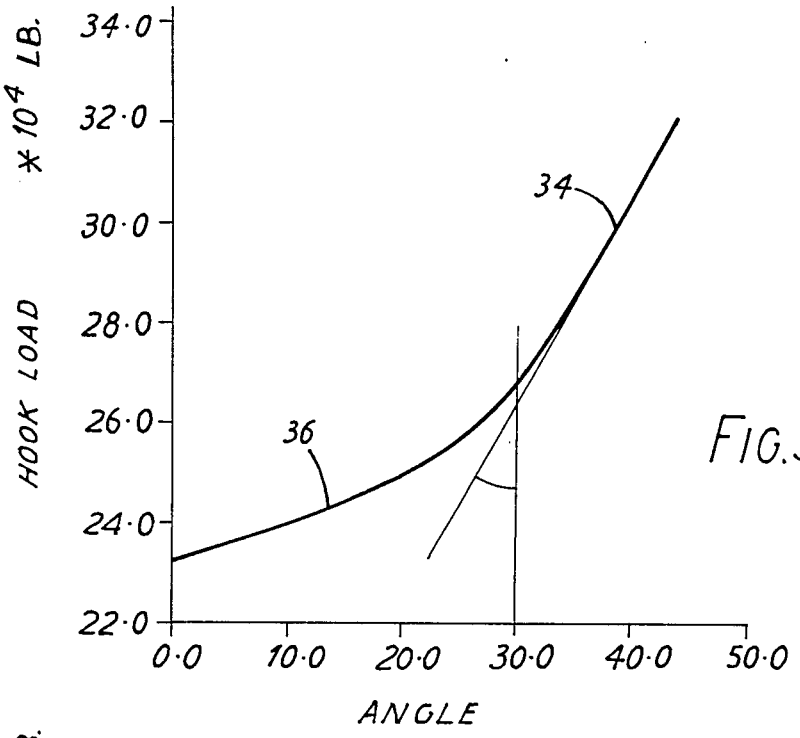
FIGS. 5 and 6 show the variation respectively of the hook load when tripping out and of the torque as a function of the angle at the end of the initial build section for a constant build trajectory.

FIG. 5 shows, for this model well, the hook load in 10K lb when tripping out from full depth as a function of the angle $\theta$ at the end of the 5° per 100 foot section, between points 30 and 32. The upper curve 34 is the hook load for the constant curvature trajectory while the lower curve 36 depicts the hook load for a catenary trajectory. The two curves 34 and 36 are virtually coincident for inclination angles above 30°. With a conventional trajectory ($\theta=44.5°$), a hook load of about 320K lb would be expected. For a curved section well with $\theta=30°$, both the catenary and the constant build trajectory reduce this figure by about 55K lb.

Figure 6:
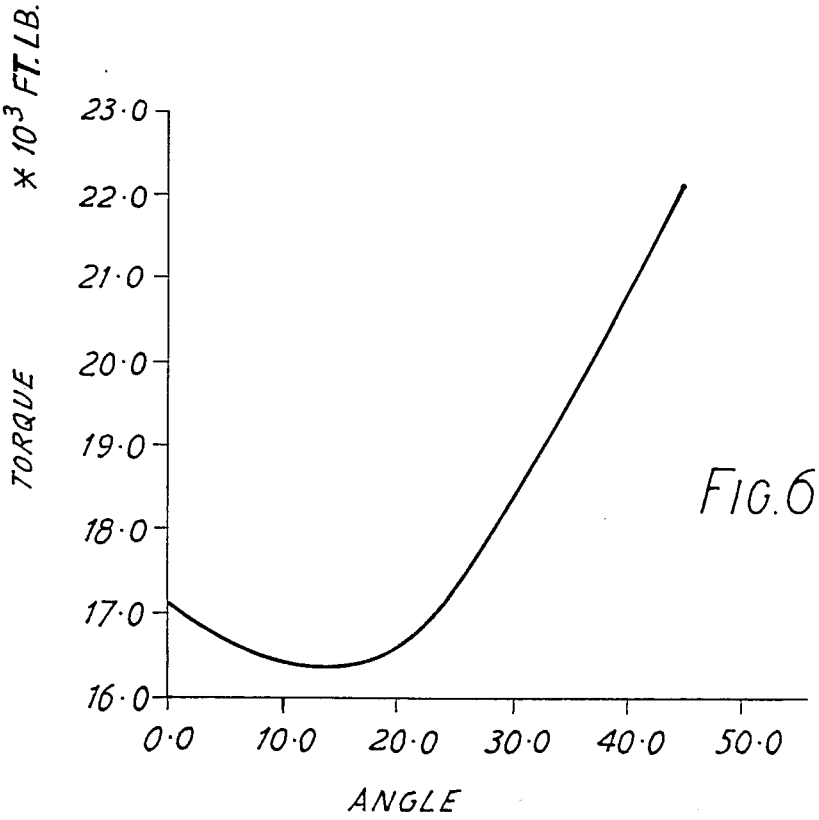

FIG. 6 shows the rotary torque as a function of $\theta$ for a well bore drilled according to the present invention. For the conventional trajectory, the torque loss from the surface to the bit is in the region of 22,500 foot lb while the constant build trajectory from inclinations of about 30° reduces this loss by about 4,500 foot lb.

While it has been shown and described in FIG. 3 what is considered to be the preferred embodiment of the invention, it will be apparent to those skilled in the art that various changes and modifications may be made therein without departing from the spirit or scope of the invention.

I claim:

1. An improved method of drilling a directional well borehole with a drill string, along a predetermined trajectory extending between a starting location at the surface and an underground final depth point horizontally and vertically displaced from said starting location, said method comprising the steps of:

(1) drilling a first, substantially vertical section of said borehole under said starting location;

(2) drilling a second section of said borehole having a substantially constant build rate, said second section immediately preceding said final depth point; and (3) drilling a third section of said borehole having a substantially constant build rate, said third section being formed at the end of said first section between said first and second sections, and said third section having a build rate substantially greater than that of said second section, and a length substantially smaller than that of said second section.

2. The method according to claim 1 characterized in that the rate of build of the inclination angle to vertical of said second section is between 0.1 and 1.5 degrees per 100 feet.

3. The method according to claim 1 characterized in that the rate of build of the angle of inclination to vertical of said third section is between 1 and 8 degrees per 100 feet.

* * * * *